US007504597B2

(12) United States Patent
Shimazu et al.

(10) Patent No.: US 7,504,597 B2
(45) Date of Patent: Mar. 17, 2009

(54) KEY SWITCH

(75) Inventors: Kenji Shimazu, Moriyama (JP); Shunkichi Sasaki, Osaka (JP); Hidemitsu Takenaka, Otsu (JP); Tetsuya Fukumoto, Kusatsu (JP); Shinya Yamamoto, Kusatsu (JP); Shinya Watanabe, Kusatsu (JP)

(73) Assignee: OMRON Corporation, Kyoto (JP)

( * ) Notice: Subject to any disclaimer, the term of this patent is extended or adjusted under 35 U.S.C. 154(b) by 81 days.

(21) Appl. No.: 11/708,804

(22) Filed: Feb. 20, 2007

(65) Prior Publication Data

US 2007/0209404 A1 Sep. 13, 2007

(30) Foreign Application Priority Data

Mar. 9, 2006 (JP) ..... P2006-064656

(51) Int. Cl.
*H01H 27/00* (2006.01)

(52) U.S. Cl. ..... 200/43.04; 200/329

(58) Field of Classification Search ... 200/43.01–43.22, 200/318, 329, 320–325, 17 R, 318.1, 334
See application file for complete search history.

(56) References Cited

U.S. PATENT DOCUMENTS 5,420,385 A * 5/1995 Cooper ..... 200/43.07
5,464,954 A * 11/1995 Kimura et al. ..... 200/61.62
5,622,253 A * 4/1997 Wecke et al. ..... 200/43.07
5,760,353 A * 6/1998 Rapp ..... 200/17 R
6,118,087 A * 9/2000 Fukui ..... 200/43.04
6,194,674 B1 * 2/2001 Fukui ..... 200/43.04
6,307,167 B1 * 10/2001 Kajio et al. ..... 200/43.11
6,720,508 B2 * 4/2004 Moriyama et al. ..... 200/200
6,861,597 B2 * 3/2005 Baechle ..... 200/43.04
6,872,898 B2 * 3/2005 Mohtasham ..... 200/43.01
7,223,927 B2 * 5/2007 Poyner ..... 200/43.04
7,339,125 B2 * 3/2008 Day et al. ..... 200/43.04
7,345,252 B2 * 3/2008 Takenaka et al. ..... 200/334
7,351,924 B2 * 4/2008 Scherl et al. ..... 200/43.08

FOREIGN PATENT DOCUMENTS

JP 2002-140962 5/2002

* cited by examiner

*Primary Examiner*—Michael A Friedhofer
*Assistant Examiner*—Lisa N Klaus
(74) *Attorney, Agent, or Firm*—Weaver Austin Villeneuve & Sampson LLP

(57) ABSTRACT

A key switch has a switch part and an operating part. The switch part is activated to switch contact points as an operating key is inserted. The operating part includes a driver cam that rotates as it is pushed by the operating key and to activate the switch part and a plurality of lock cams configured to directly lock the driver cam in a normal condition when the operating key is pulled out of the operating part and to rotate as it is pushed by the operating key so as to release the driver cam from its locked condition. The key switch may further include lock cam holder for holding the lock cams in the normal condition when the operating key is pulled out.

9 Claims, 7 Drawing Sheets

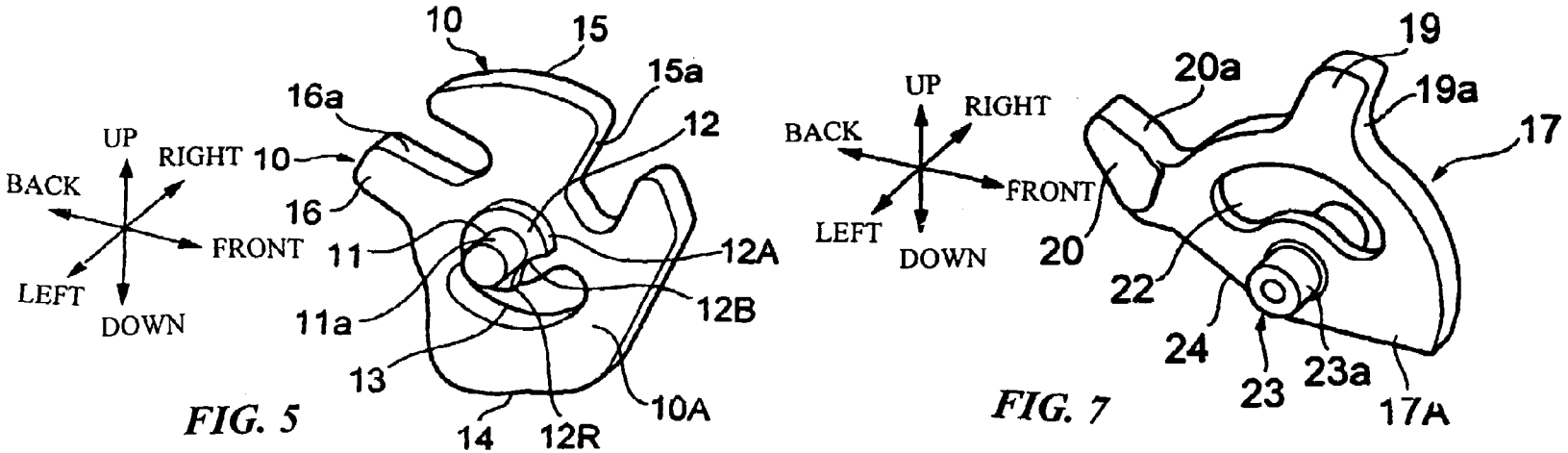
FIG. 5
FIG. 7
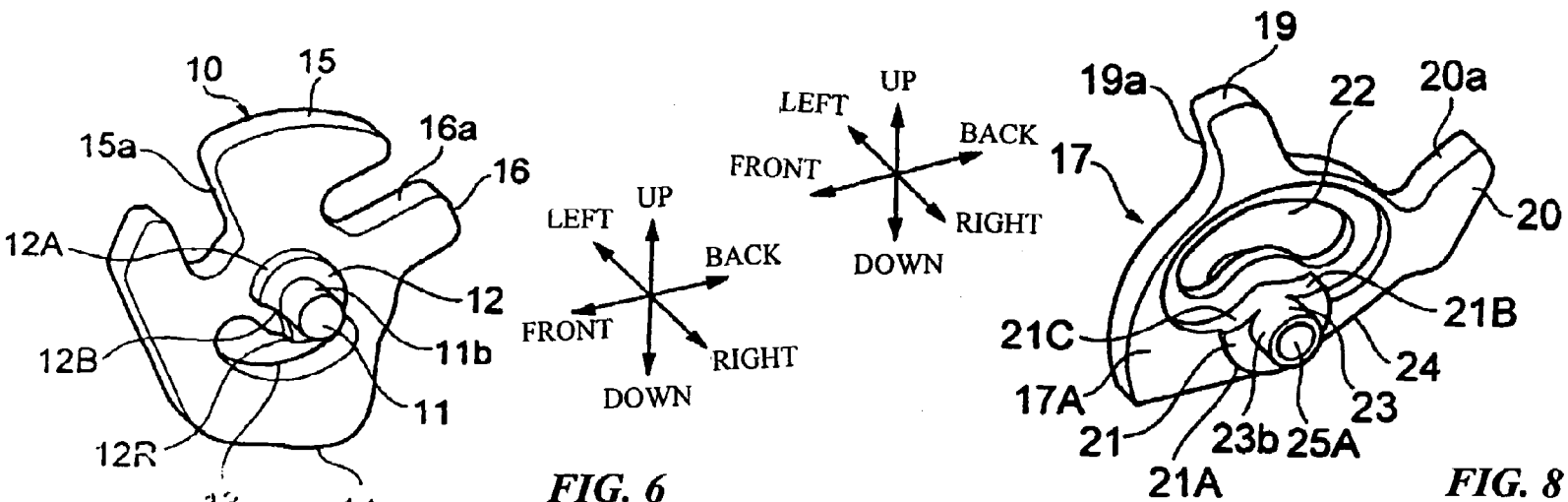
FIG. 8
FIG. 6

KEY SWITCH

This application claims priority on Japanese Patent Application 2006-064656 filed Mar. 9, 2006.

BACKGROUND OF THE INVENTION

This invention relates to a key switch as an example of safety switch that may be used, for example, as a door lock switch.

A door lock switch is generally for the purpose of detecting the open or closed condition of a door to a work area containing an automated fabrication machine, serving to switch on and off the power to the machine and locking the door such that it will not open when the machine is in operation.

Such a door lock switch is usually structured such that an operating key provided to the door becomes inserted to a key switch at the entrance as the door is closed, a cam member becoming rotated by the inserted key to switch on a switching part contained within the key switch. When this door is to be opened while the machine is in operation, an operation for stopping the machine is first carried out at an external operating part such that the operating key is pulled out as the door is opened and the cam member is rotated such that the switching part is switched off to disconnect the power supply.

In the above, the cam member is usually structured so as to be at a normal initial position by locking means when the operating key is pulled out such that it cannot be rotated unless its dedicated operating key is employed or easily switched to a switched-on condition by means of an ordinary tool.

FIGS. 17 and 18 show an operating part 77 of a prior art key switch of this type (such as shown in Japanese Patent Publication Tokkai 2002-140962), provided with a pair of intermediate members 71 on both sides of a driver cam 70 so as to be rotatable coaxially therewith. A pair of locking members 72 is provided so as to contact and thereby engage with engaging parts 70a on outer peripheral surfaces of the driver cam 70. As an actuator 73 is advanced and the intermediate members 71 rotate around an rotary shaft 74 against the biasing force of a torsion spring 73, the locking members 72 are moved outward from each other against the biasing force of a coil spring 75 such that the driver cam 70 is released from the engaged condition with the locking members 72 and becomes rotatable. This also causes an operating rod 76 to protrude upward (with reference to the figure) by means of a return spring (not shown) and to open each of normally closed contact points to supply power to a machine to bring it into an operable condition. Although there is an attempt to reduce the overall thickness, the operating part 77 thus structured has many components and is complicated such that its production cost is disadvantageously high.

FIGS. 19-21 show an operating part of another prior art key switch, provided with a driver cam 80 having head lock grooves 81 on both sides, a pair of head lock members 82 having locking parts 83 and a pair of coil springs 84. The driver cam 80 is rotatably supported by a base structure (not shown) through a supporting shaft 85. The head lock members 82 are provided on both sides of the driver cam 80, supported by the supporting shaft 85 so as to be movable reciprocatingly in the direction of the driver cam 80 and pressed towards the driver cam 80 by the force of the coil springs 84 so as to disengageably engage the locking parts 83 with the head lock grooves 81 and to thereby keep the driver cam 80 at its initial rotary position.

As an operating key (not shown) is inserted into the operating part, the tip of this operating key is contacted to the inner surface of the head lock members 82 so as to move both head lock members 82 against the force of the spring, disengaging the locking parts 83 from the head lock grooves 81 to thereby release the driver cam 80 from its locked condition and to leave the driver cam 80 in a rotatable condition. At the same time, an operating rod 86 is moved downward (with reference to FIG. 19) by means of a returning spring (not shown) so as to open each of normally closed contact points to supply power to a machine to bring it into an operable condition.

With an operating part thus structured, the number of components can be reduced but its transverse dimension in the direction of the width tends to be large because the head lock members 82 and the coil springs 85 are arranged in the direction of its width. Moreover, since the opening (not shown) for inserting the operating key remains open all the time, foreign objects such as dust particles are likely to enter therethrough between the driver cam 80 and the head lock members 82. This may have the undesirable effect of preventing the head lock members 82 from effectively locking the driver cam 80, enabling an ordinary tool other than the dedicated actuator, such as a screw driver, inserted into the opening to rotate the driver cam 80 and to activate the switch part.

SUMMARY OF THE INVENTION

It is therefore an object of this invention to provide a key switch, which is comprised of a smaller number of components, can be produced at a lower cost, is easy to assemble, is smaller in thickness, and is capable of preventing tools other than the dedicated actuating tool from causing its driver cam to rotate.

A key switch embodying this invention may be characterized as comprising a switch part and an operating part for having an operating key inserted thereinto so as to activate the switch part to switch contact points. The operating part includes a driver cam configured to rotate as it is pushed by the operating key and to thereby activate the switch part and a plurality of lock cams configured to directly lock the driver cam in a normal condition when the operating key is pulled out of the operating part and to rotate as it is pushed by the operating key so as to release the driver cam from its locked condition. The key switch may further include lock cam holding means for holding the lock cams in the normal condition when the operating key is pulled out.

With a key switch thus structured, the driver cam can be released from its locked condition (or its normal condition with the operating key removed) and made rotatable by rotating the lock cams by means of the operating key, and the driver cam is rotated under this condition to activate the switch part and to carry out the switching of the contact points.

Thus, the lock cams serve to directly lock the driver cam to keep it in its normal condition and since this locked condition is released as the lock cams are rotated, the number of constituent components can be reduced and hence the production cost can be decreased. The assembly work of these constituent components becomes easier, and the thickness of the key switch can be reduced since there is no head lock to be moved transversely in the direction of the width as in the case of prior art devices.

Since the locking of the driver cam is effected by the rotation of the lock cams, the locking can be effected even if a foreign object becomes inserted in the lock cams, and this means that the rotation of the driver cam by any device other than the dedicated actuator can be prevented.

According to this invention, the driver cam and the lock cams are made to rotate around different points such that the rotational trajectories of the driver cam and the lock cams can be individually varied.

The key switch of this invention may be further characterized wherein the driver cam has a rotary shaft ("first rotary shaft") and engaging protrusions ("first engaging protrusions") at the center of rotation, wherein the lock cams have rotary shafts ("second rotaty shafts") and engaging protrusions ("second engaging protrusions") at the center of rotation, wherein the second engaging protrusions on the lock cams become disengageably engaged with the first engaging protrusion on the driver cam to prevent the driver cam from rotating when the lock cams are not being pushed by the operating key and wherein the second engaging protrusions are caused to rotate to thereby disengage the first engaging protrusions and to make the driver cam rotatable if the operating key pushes and causes the lock cams to rotate.

With the key switch thus structured, the driver cam can be prevented from rotating as the second engaging protrusion comes to disengageably engage with the first engaging protrusion when the lock cams are not being pushed by the operating key, and the driver cam can be made rotatable by pushing the operating key to cause the lock cams to rotate and the second engaging protrusions to rotate so as to release the engagement with the first engaging protrusion. Thus, components dedicated to the prevention of the rotation of the driver cam become unnecessary and the number of constituent components can be reduced.

Since the first engaging protrusion is provided together with the first rotary shaft at the center of its rotation and since the second engaging protrusions are provided together with the second rotary shafts at the center of rotation, the operating part can be miniaturized and hence the overall size of the key switch can be made more compact. If the lock cams are superposed onto the driver cam, furthermore, the first and second engaging protrusions can be joined together and hence the assembly work becomes simplified.

The key switch of this invention may still further be characterized wherein the first engaging protrusion is formed by connecting a first arcuate surface portion and a second arcuate surface portion which is at an edge portion opposite the second engaging protrusion and, having its center at the center of the second rotary shaft, is concave towards the center of the first engaging protrusion, wherein the second engaging protrusions are each formed by connecting a third arcuate surface portion and a fourth arcuate surface portion which is at an edge portion opposite the first engaging protrusion and, having its center at the center of the first rotary shaft, is concave towards the center of the second engaging protrusion, and wherein the driver cam is prevented from rotating and is kept in the normal locked condition as a connecting corner part between the third arcuate surface portion and the fourth arcuate surface portion is disengageably engaged to a connecting part between the first arcuate surface portion and the second arcuate surface portion of the first engaging protrusion.

With the key switch thus structured, since the rotary motion of the driver cam is controlled as the connecting part becomes disengageably engaged with the corner part of the first engaging protrusion while the lock cams are not being pushed by the operating key and since the driver cam is made rotatable by releasing this engagement as the operating key is pushed to rotate the lock cams and to cause the second engaging protrusions to rotate, components dedicated to the control of the rotation of the driver cam become unnecessary and the number of constituent components can be reduced.

The key switch of this invention may still further be characterized wherein the operating key has a driver cam operating part at a front edge and lock cam operating parts formed on both sides of the driver cam operating part and displaced from the driver cam operating part in the direction of the thickness of the operating key, the lock cam operating parts protruding farther forward than the driver cam operating part, and wherein the driver cam has a first pressure receiving part on which the driver cam operating part is configured to come to contact, the lock cams have a second pressure receiving part on which the lock cam operating part is configured to come to contact, and the second pressure receiving part is positioned closer than the first pressure receiving part to the center of rotation of the lock cams.

With the key switch thus structured, the radius of rotation of the lock cams can be reduced, with the second pressure receiving part of the lock cams being closer to the center of rotation of the lock cams than the first pressure receiving part of the driver cam. Thus, the lock cams can be made smaller and the operating part need not become larger although the centers of rotation of the driver cam and the lock cams are different.

In the above, the driver cam may have a first arcuate opening with the center at the first rotary shaft, the lock cams may have a second arcuate opening with the center at the second rotary shaft, the second rotary shafts may be connected to each other by inserting the first rotary shaft through the second arcuate opening and inserting the second rotary shaft through the first arcuate opening.

With such a structure, interference between the rotating driver cam and the second rotary shaft and between the rotating lock cams and the first rotary shaft can be prevented. This means that there is no need for means for holding rotary shafts such as a bearing between the different cams and the operating part can be prevented from becoming large.

In the above, the connection between the second rotary shafts may be effected by engaging an engaging protruding portion formed on an end part of one of them with an engaging indented portion or an opening formed on an end part of the other. With the second rotary shafts thus connected to each other, the plurality of lock cams can be treated as a single shaft and means such as a bearing may be dispensed with for holding the shafts together.

In the above, the lock cam holding means may include a plate spring that serves to hold the lock cams such that the second engaging protrusion is held at a position for engaging with the first engaging protrusion. The lock cam holding means may alternatively include a coil spring that serves to hold lock cams such that the second engaging protrusions are held at a position for engaging with the first engaging protrusion.

In summary, with a key switch according to this invention, the lock cams serve to directly lock the driver cam to keep it in its normal locked condition when the operating key is pulled out and this locked condition is released by their rotation. Thus, the number of constituent components and the production cost can be reduced, the assembly work becomes simpler and the operating part can be made thinner. Because the driver cam is locked by the rotary motion of the lock cams, the lock cams remain rotatable even if a foreign object is inserted. Thus, the rotation of the driver cam by means of a device other than the dedicated operating key as the actuator can be prevented.

BRIEF DESCRIPTION OF THE DRAWINGS

FIG. 5 is a diagonal view of the driver cam of the operating unit as seen from the left-hand side.

FIG. 6 is a diagonal view of the driver cam of the operating unit as seen from the right-hand side.

FIG. 7 is a diagonal view of the lock cam on the left-hand side of the operating unit as seen from the left-hand side.

FIG. 8 is a diagonal view of the lock cam of FIG. 7 as seen from the right-hand side.

DETAILED DESCRIPTION OF THE INVENTION

Figure 2:
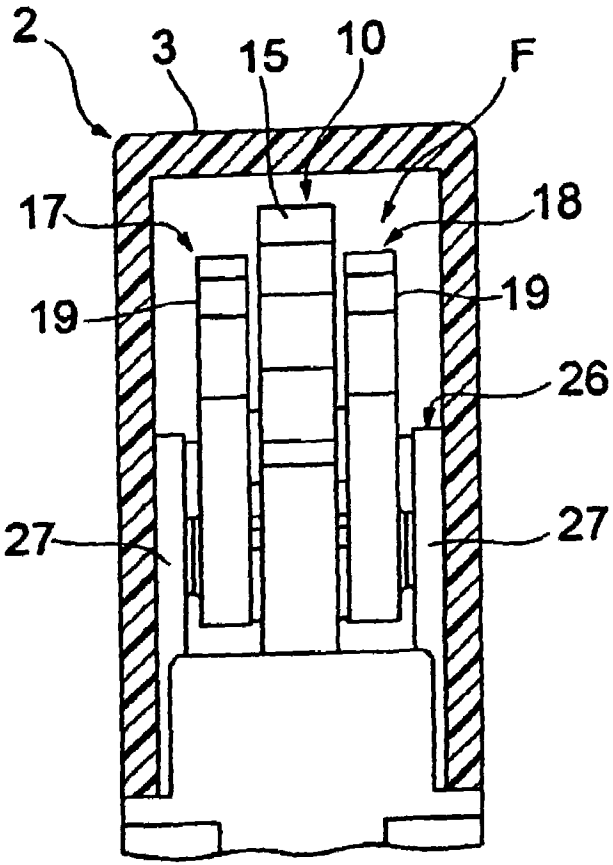
FIG. 2 is a vertical sectional view of the operating part of the key switch of FIG. 1.
Figure 1:
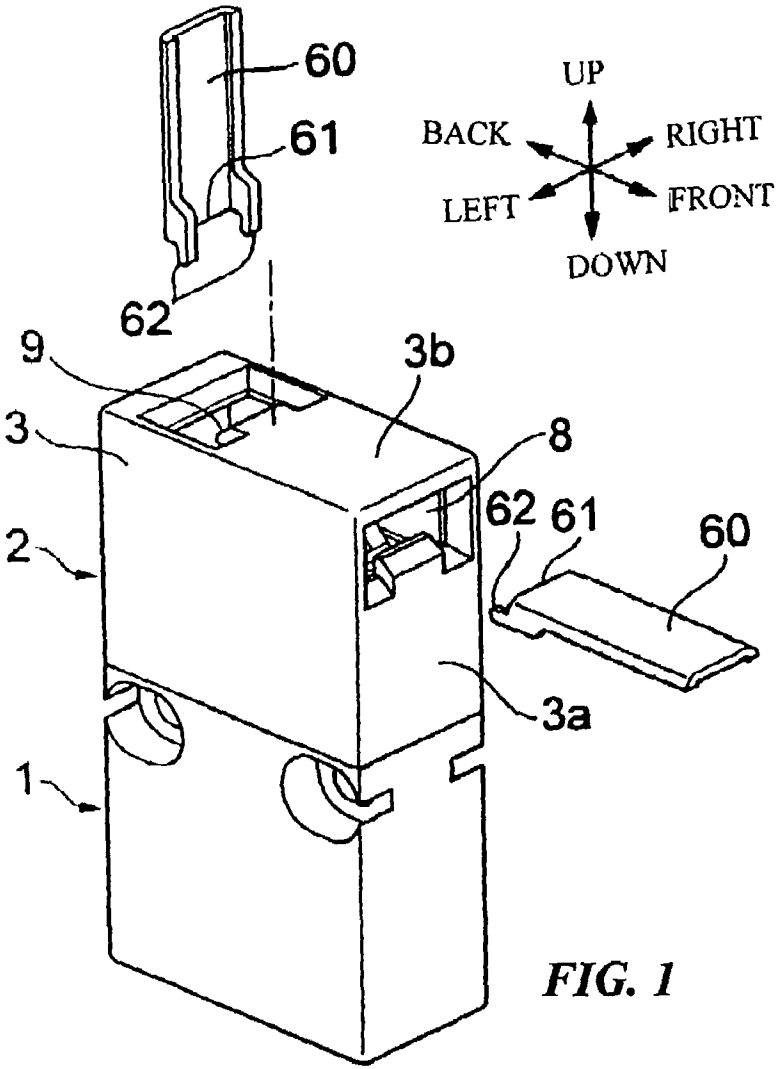
FIG. 1 is a diagonal view of a key switch embodying this invention.
Figure 4:
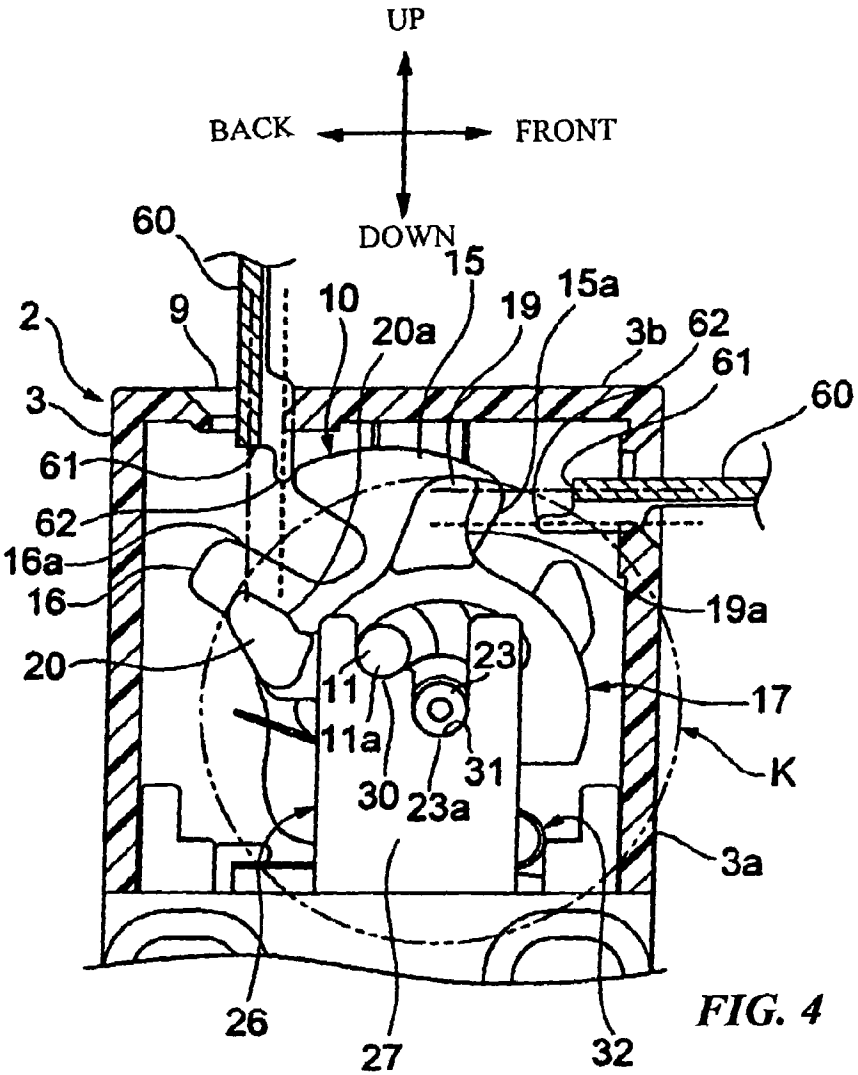
FIG. 4 is a side view of the operating part of FIG. 2 with a portion of the head cover removed.
Figure 3:
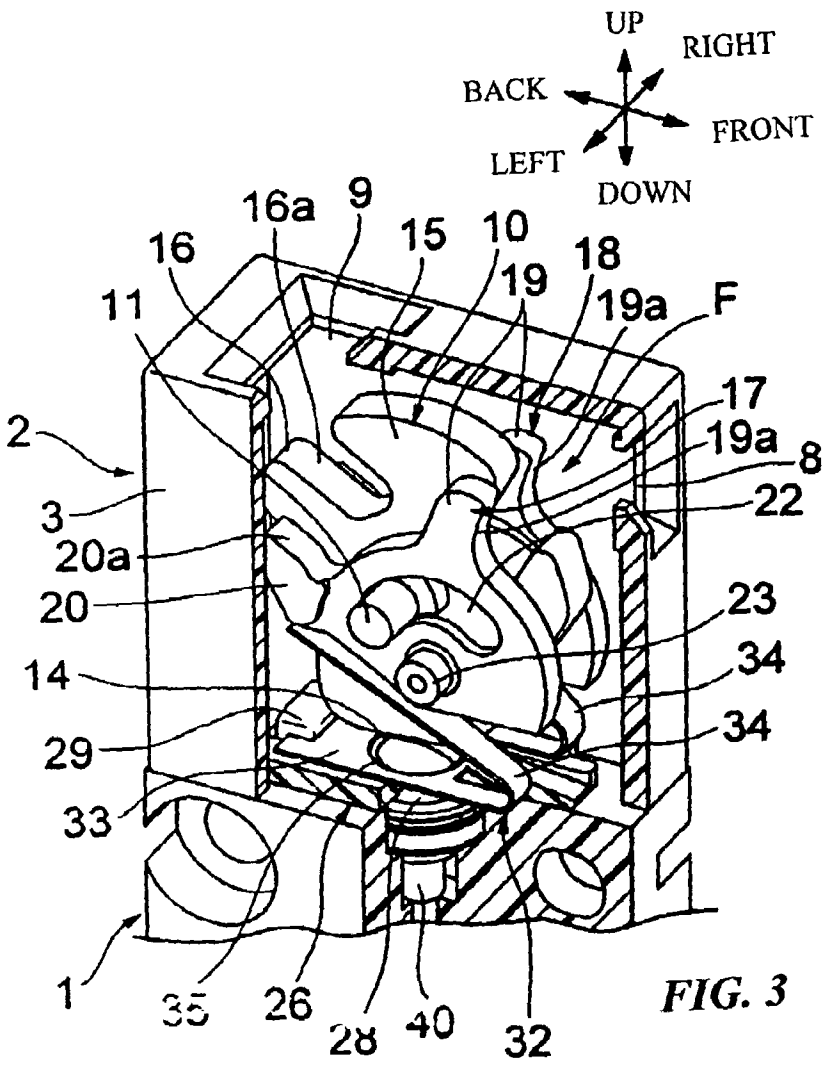
FIG. 3 is a diagonal view of the operating part of FIG. 2 with portions of the head cover and base removed to show the operating unit.

The invention is described next with reference to the figures. FIG. 1 is a diagonal view of a key switch embodying this invention. FIG. 2 is a vertical sectional view of the operating part of the key switch of FIG. 1. FIG. 3 is a diagonal view of this operating part with portions of the head cover and base removed to show its operating unit. FIG. 4 is a side view of this operating part with a portion of the head cover removed. For the convenience of the description, directions are defined with respect to the operating key as shown in individual figures.

The key switch is comprised of a main body 1 and its operating part 2. Inside this main body 1 is a switch part (not shown) structured such that its contact points will be switched as an operating rod 40 shown in FIG. 3 is moved. Explained more in detail, if this operating rod 40 is pushed in, a returning spring (not shown) is compressed so as to bring about a switched-on condition (such as the on-condition of a NO (normally open) contact point or a separated condition of a NC (normally closed) contact point) and if the compressing force on the operating rod 40 is released, the returning force of the returning spring will bring about a switched-off condition (such as a separated condition of a NO contact point or the on-condition of a NC contact point).

As shown in FIGS. 2 and 3, the operating part 2 is provided with an operating unit F and a head cover 3 that covers this operating unit F. As shown in FIG. 1, the head cover 3 is provided with insertion openings 8 and 9 on its front surface 3*a* and top surface 3*b*, respectively, for inserting an operating key 60 (to be described further below).

The operating unit F is comprised of a driver cam 10, a pair of (left and right) lock cams 17 and 18, a base member 26 and a spring member 32 serving as a lock cam holder.

As shown in FIGS. 5 and 6, the driver cam 10 has a cam shaft ("first rotary shaft") 11 at the rotary center of its main body 10A. On the circumference of the main body 10A are protruding key engaging parts 15 and 16 with a phase difference of about 90 degrees therebetween. Key engaging part 15 has its front side serving as a pressure receiving part 15*a*. Key engaging part 16 has its upper side as its pressure receiving part 16*a*.

On the left-hand and right-hand side surface portions of the cam main body 10A, engaging protrusions 12 are provided around the cam shaft 11. These engaging protrusions 12 are each formed as a continuation of an arcuate surface portion 12A and a recessed surface portion 12B which is arcuate and,concave towards the center of the engaging protrusion 12. The cam main body 10A is also provided with an arcuate-shaped opening 13 having a center at the cam shaft 11 and opposite from the protruding key engaging part 15. A cam surface part 14 is further formed at a position opposite from the key engaging part 15, As shown in FIGS. 7 and 8, the left-hand lock cam 17 comprises a planar main body 17A, which is nearly semi-circular and has a cam shaft ("second rotary shaft") 23 at its center. An inner (right-hand) component 23*b* of this cam shaft 23 is provided with an engaging hole or indentation 25A as shown in FIG. 8.

On the circumference of the main body 17A are protruding key engaging parts 19 and 20 with a phase difference of about 90 degrees therebetween. Key engaging part 19 has its front side serving as a pressure receiving part 19*a*. Key engaging part 20 has its upper side as its pressure receiving part 20*a*.

On the inner (right-hand side) surface portion of the cam main body 17A, an engaging protrusion ("second engaging protrusion") 21 is provided around the cam shaft 23. This engaging protrusion 21 is formed as a continuation of an arcuate surface portion 21A and two recessed surface portions 21B and 21C which are arcuate and concave towards the center of the engaging protrusion 21. The cam main body 17A is also provided with an arcuate-shaped opening 22 having a center at the cam shaft 23 and opposite. A spring contact part 24 is further formed at a position opposite from the key engaging part 19.

Figure 9:
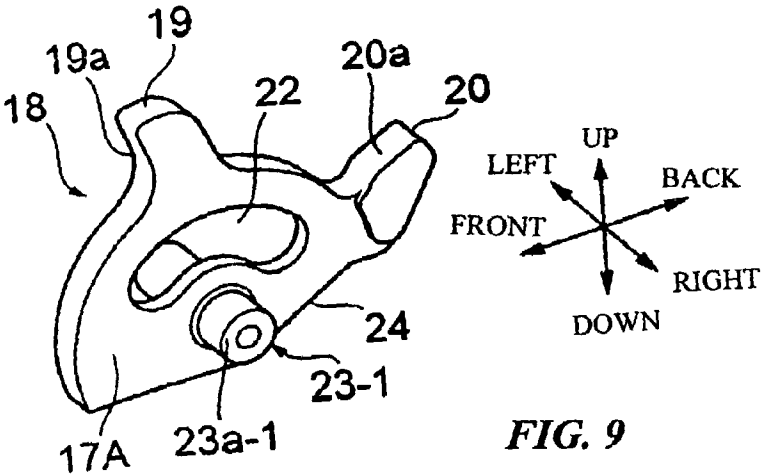
FIG. 9 is a diagonal view of the lock cam on the right-hand side of the operating unit as seen from the right-hand side.
Figure 10:
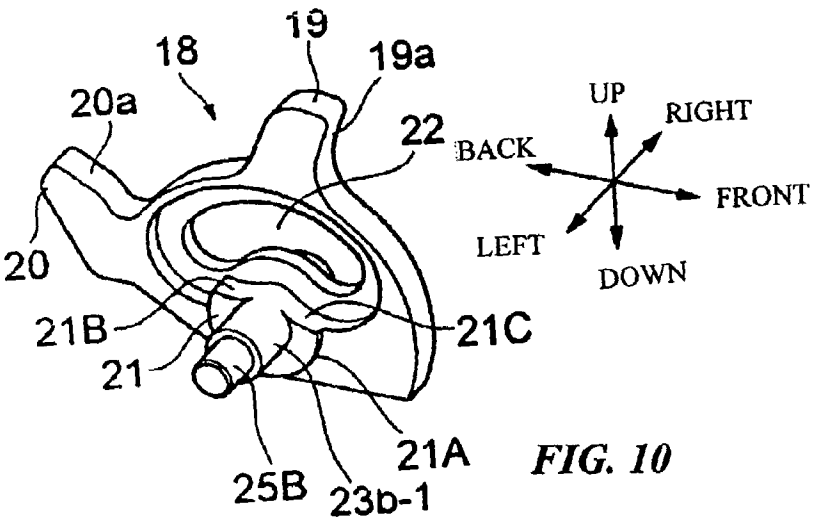
FIG. 10 is a diagonal view of the lock cam of FIG. 9 as seen from the left-hand side.

As shown in FIGS. 9 and 10, the left-hand lock cam 18 is in plane symmetry with the right-hand lock cam 17 except for the cam shaft. Thus, equivalent components are indicted by the same symbols and will not be repetitively described. The inner (left-hand) component 23*b*-1 of the cam shaft 23-1 has a connecting shaft part 25B formed, as shown in FIG. 10, for engaging the aforementioned engaging hole 25A of the cam shaft 23.

Next, the shape of the engaging protrusion 12 on the side of the driver cam 10 and that of the engaging protrusion 21 on the sides of the lock cams 17 and 18 will be explained with reference to FIG. 11.

Figure 11:
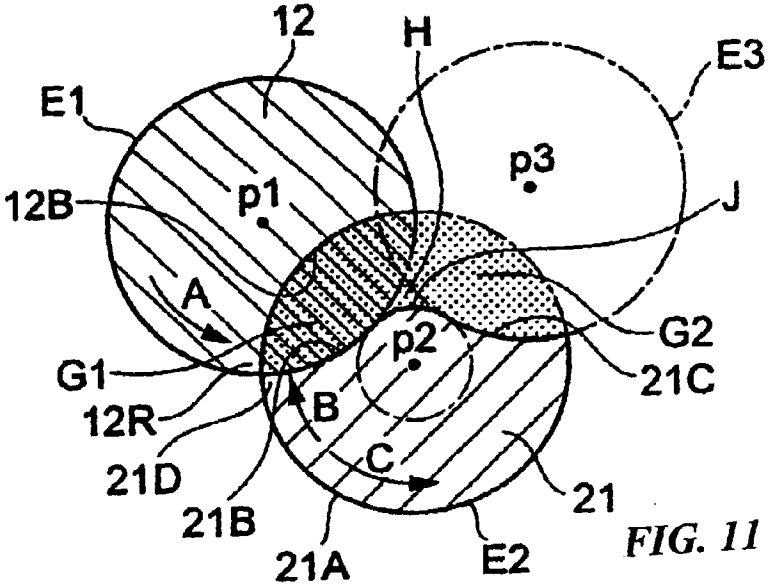
FIG. 11 is a drawing for explaining the shape of the first and second engaging protrusions on the driver and lock cams.

Consider three circles E1, E2 and E3 of the same size arranged such that their centers p1, p2 and p3 form an equilateral triangle, or that the distance between points p1 and p2 is equal to that between points p2 and p3, as shown in FIG. 11. If portion G1 of the first circle E1 overlapping with the second circle E2 is removed, the arcuate protrusion that remains for the first circle E1 corresponds to the aforementioned engaging protrusion 12, and the removed portion comes to correspond to the recessed portion 12B.

Similarly, the arcuate protrusion that remains of the second circle E2 after overlapping portion G1 between the first and the second circles E1 and E2 is removed and overlapping portion G2 between the second and the third circles E2 and E3 is removed corresponds to the aforementioned engaging protrusion 21. The removed overlapping portion G1 corresponds to the recessed portion 21B and the removed overlapping portion G2 corresponds to the recessed portion 21C. The corner portion between the circular arc-shaped surface portion 21A of the engaging protrusion 21 on the side of the lock cam and the recessed portion 21B are referred to as engaging part 21D. The portion H sandwiched between the two recessed portions 21B and 21C is removed and the remaining surface portion therebetween is referred to as connection surface J.

Recessed portion 12B on the side of the driver cam and recessed portion 21B on the side of the lock cam are shaped so as to allow the driver cam 10 and the lock cams 17 and 18 to rotate. Recessed portion 21C on the side of the lock cam makes it possible for the lock cams 17 and 18 to rotate in the direction of arrow C as the driver cam 10 rotates in the direction of arrow A.

As shown in FIGS. 2-4, the base member 26 has support members 27 on the left-hand and right-hand sides and is also provided with an insertion opening 28 and a spring attachment part 29 on the base surface. The support members 27 have shaft supporting parts 30 and 31 formed thereon, respectively for supporting the cam shaft 11 of the driver cam 10 and the cam shafts 23 (23-1) of the lock cams 17 and 18.

The aforementioned spring member 32 is a plate spring, as shown in FIG. 3, having an attachment part 33 and a pair of spring pieces 34 which are bent to form an acute angle with the attachment part 33. An insertion opening 35 for the operating rod 40 is provided to the attachment part 33. The attachment part 33 of the spring member 32 is attached to the spring attachment part 29 of the base member 26 so as to mount the spring member 32 with the insertion openings 28 and 35 overlapping with each other.

Figure 12:
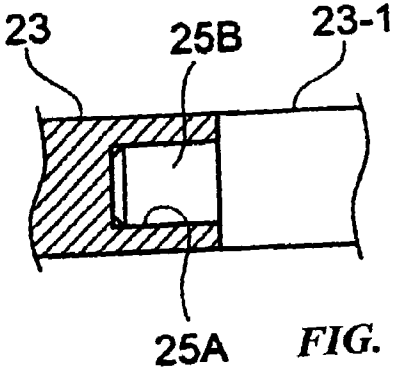
FIG. 12 is a sectional view of the connecting part of the cam shaft of the lock cam on the left-hand side and the right-hand side.

As shown in FIGS. 2 and 3, the driver cam 10 is sandwiched between the lock cams 17 and 18 from the left and the right. A left-hand component 11*a* of the cam shaft 11 of the driver cam 10 penetrates the left-hand opening 22 and a right-hand component 11*b* of the cam shaft 11 penetrates the right-hand opening 22. The inner (right-hand) component 23*b* of the cam shaft 23 of the left-hand lock cam 17 and the inner (left-hand) component 23*b*-1 of the cam shaft 23-1 of the right-hand lock cam 18 are both inserted into the opening 13. As shown in FIG. 12, a connecting shaft part 25B of the cam shaft 23 engages in engaging hole 25A of the cam shaft 23-1 so as to connect the cam shafts 23 and 23-1.

As shown in FIG. 4, the left-hand component 1 la of the cam shaft 11 of the driver cam 10 is supported by the shaft supporting part 30 of the left-hand support members 27 and the right-hand component 11*b* of the cam shaft 11 is supported by the shaft supporting part 30 of the right-hand support member 27, both in a rotatable manner. Furthermore, an outer (left-hand) component 23*a* of the cam shaft 23 of the left-hand lock cam 17 is rotatably supported by the shaft supporting part 31 of the left-hand support member 27 and an outer (right-hand) component 23*a*-1 of the cam shaft 23-1 of the right-hand lock cam 18 is rotatably supported by the shaft supporting part 31 of the right-hand support member 27.

As described above, the operating unit F is formed by mounting the driver cam 10 and the pair of lock cams 17 and 18 to the base member 26 such that, as shown in FIG. 3, the left-hand spring piece 34 of the spring member 32 contacts the spring contact part 24 of the left-hand lock cam 17, the right-hand spring piece 34 of the spring member 32 contacts the spring contact part 24 of the right-hand lock cam 18 and the pair of lock cams 17 and 18 is thus kept at their normal locked position.

As shown in FIGS. 3 and 4, the base member 26 is contained inside the head cover 3. In this situation, the lock cams 17 and 18 are held in the locked position by the biasing force of the spring member 32 in the clockwise direction shown by arrow B in FIG. 13, and the engaging parts 21D of the engaging protrusions 21 of the lock cams 17 and 18 are engaged with an angular corner portion 12R of the engaging protrusion 12 on the side of the driver cam, thereby preventing the driver cam 10 from rotating in the counter-clockwise direction shown by arrow A.

In this locked condition, the pressure receiving parts 15*a* and 19*a* on the sides of the driver and lock cams are opposite to the insertion opening 8, and the pressure receiving parts 19*a* are closer to the cam shafts 23 and 23-1 of the lock cams 17 and 18 than the pressure receiving part 15*a* on the side of the driver cam. The pressure receiving parts 16*a* and 20*a* are opposite to the insertion opening 9, and the pressure receiving parts 20*a* are closer to the cam shafts 23 and 23-1 of the lock cams 17 and 18 than the pressure receiving part 16*a* on the side of the driver cam. Thus, the lock cams 17 and 18 may be of a small radius and can be contained within the circle indicated by letter K in FIG. 4.

The operating part 2 is set to the switch main body 1 such that its operating rod 40 is pressed upward by means of a returning spring (not shown) and a tip portion of the operating rod 40 is in contact with the cam surface part 14 of the driver cam 10.

Figure 15:
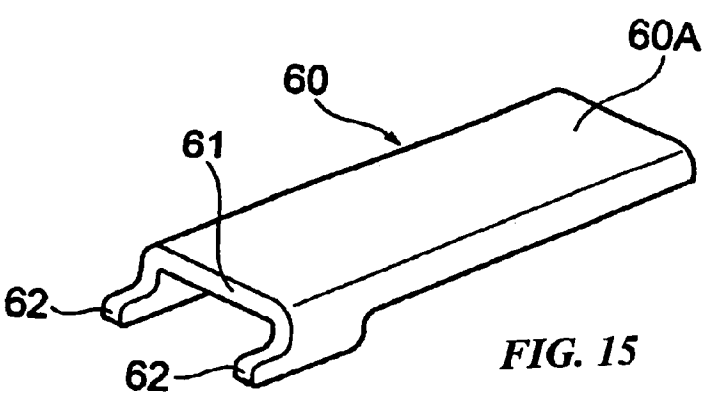
FIG. 15 is a diagonal view of the operating key.

As shown in FIG. 15, the operating key 60 serving as an actuator has an elongated key main body 60A with its tip portion serving as a driver cam operating part 61. On both sides of the front of the key main body 60A are lock cam operating parts 62 of which the tip portions protrude farther forward than the driver cam operating part 61.

Next will be explained a situation wherein the key switch as described above is being used as a safety switch for a door to a protective fence surrounding a fabrication machine (not shown). The operating key 60 is attached to the door with the key switch attached to the supporting column (not shown) of the protective fence with its axis in the vertical direction.

Figure 13:
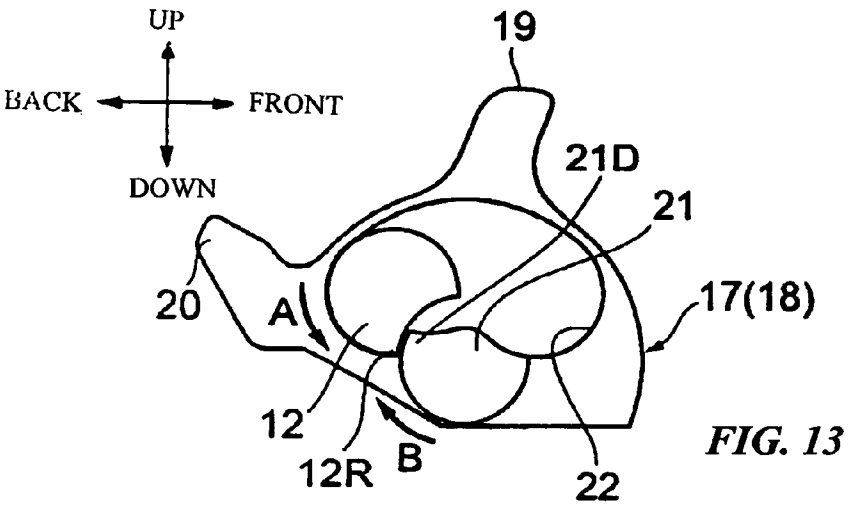
FIG. 13 is a drawing for showing the engaged condition of the first and second engaging protrusions.

When the door is open, the operating key 60 is pulled off from the operating part 2, and its lock cams 17 and 18 are in the rotation limiting (locked) condition by means of the spring member 32. As shown in FIG. 13, the engaging parts 21D of the engaging protrusions 21 of the lock cams 17 and 18 are engaged with the angular corner portions 12R of the engaging protrusions 12, limiting the rotation in the counter-clockwise direction of the driver cam 10 in the direction of arrow A and holding the driver cam 10 in its normal position.

Figure 14:
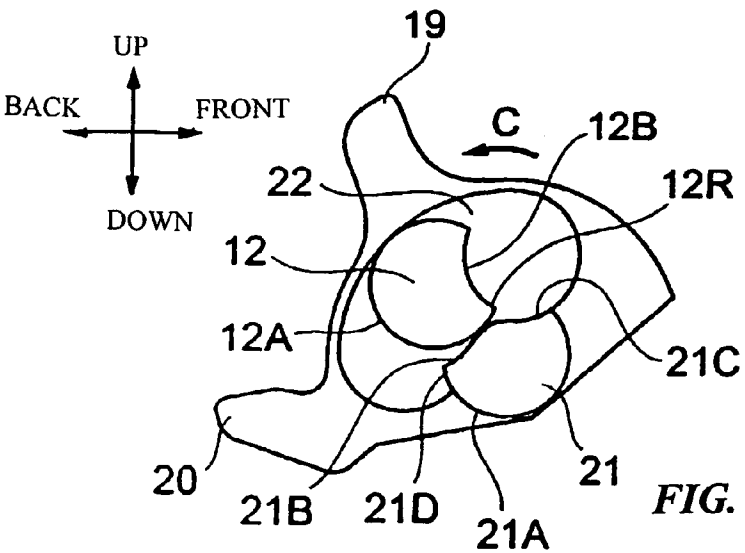
FIG. 14 is a drawing for showing the disengaged condition of the first and second engaging protrusions.
Figure 19:
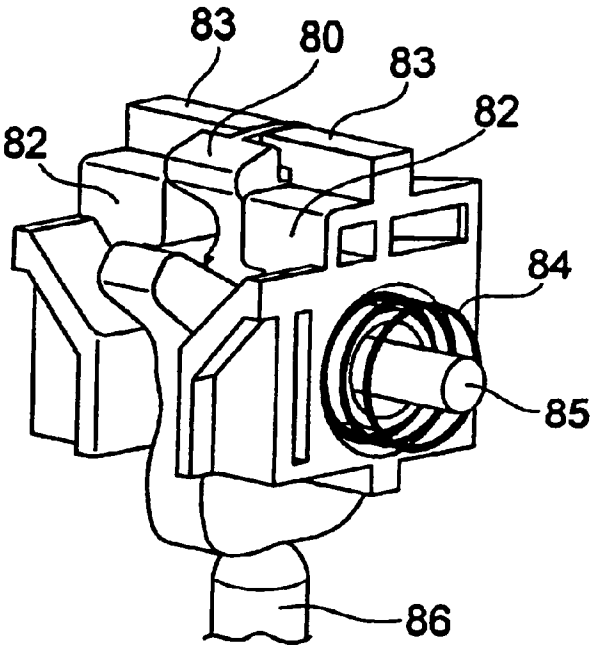
FIG. 19 (PRIOR ART)
FIG. 19 is a diagonal view of the operating unit of another prior art key switch.
Figure 17:
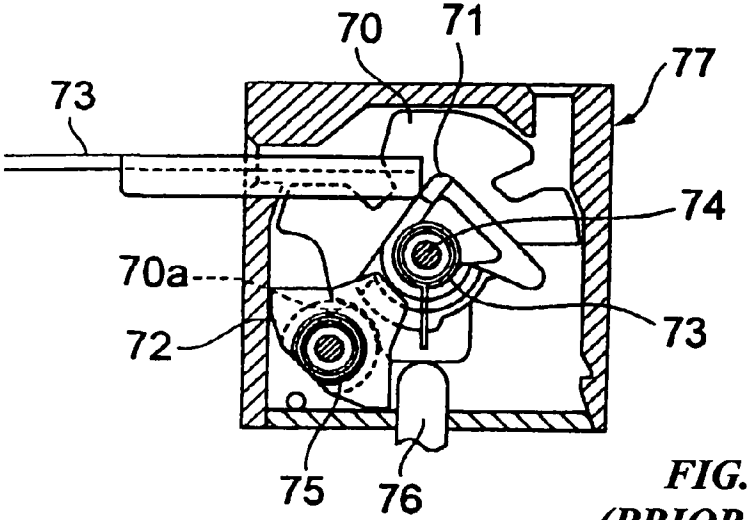
FIG. 17 (PRIOR ART)
FIG. 17 is a side view of the operating unit of a prior art key switch with a portion of its head cover removed.
Figure 18:
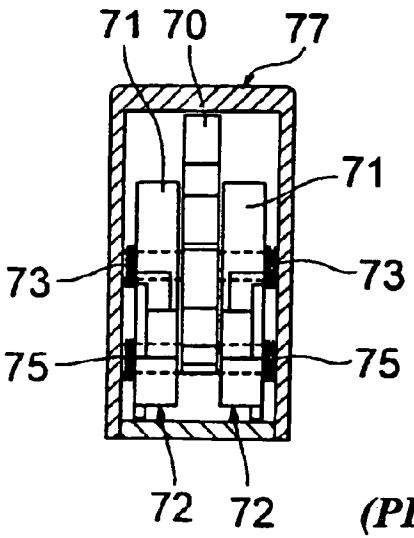
FIG. 18 (PRIOR ART)
FIG. 18 is a front view of the operating unit of FIG. 17.
Figure 20:
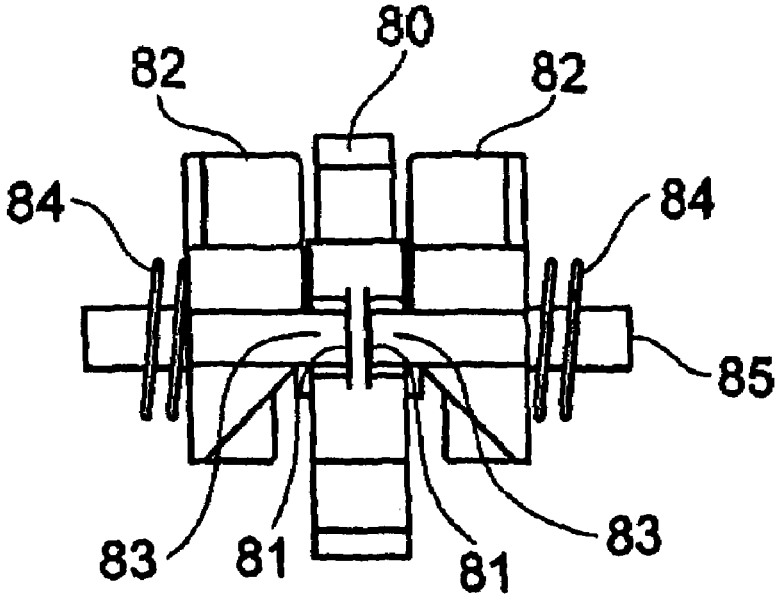
FIG. 20 (PRIOR ART)
FIG. 20 is a drawing for showing the locked condition of the driver cam of the operating unit of FIG. 17.
Figure 21:
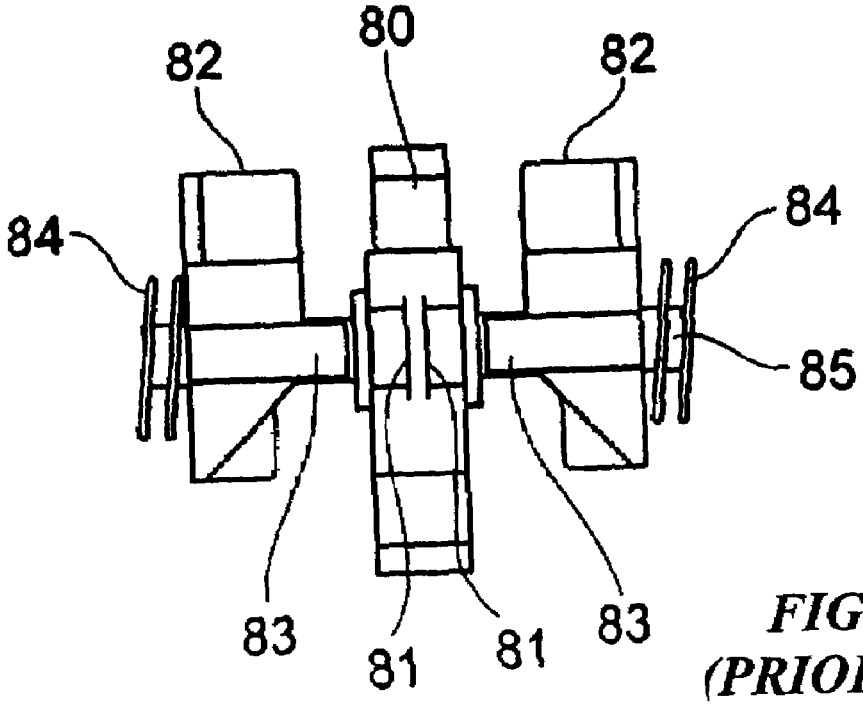
FIG. 21 (PRIOR ART)
FIG. 21 is a drawing for showing the unlocked condition of the drive cam of the operating unit of FIG. 17.

In this rotation limiting condition, the pressure receiving parts 15*a* and 19*a* face the insertion opening 8 and the operating rod 40 is pushed up by the biasing force of the returning spring such that its tip portion is slidingly in contact with the cam surface part 14 of the driver cam 10 and power is shut off from the fabrication machine. Thus, the fabrication machine is not activated while the door is in the open condition As the operating key 60 is inserted into the insertion opening 8 while the door is closed, the lock cam operating parts 62 of the operating key 60 contact the pressure receiving parts 19*a* such that the lock cams 17 and 18 are rotated in the counter-clockwise direction shown by arrow C in FIG. 14 against the biasing force of the spring member 32. Thus, the engaging parts 21D of the engaging protrusions 21 become disengaged from the angular corner portion 12R of the driver cam 10, and the driver cam 10 becomes able to rotate.

As the driver cam operating part 61 of the operating key 60 presses the pressure receiving part 15*a*, the driver cam 10 rotates in the counter-clockwise direction in FIG. 4 so as to push in the operating rod 40 contacting the cam surface part 14 against the returning force of the returning spring. Thus, the power is switched on for the fabrication machine.

If the door is opened during the operating time, a machine stopping operation is carried out first outside. As the door is pulled and opened, the operating key 60 is also pulled and moves backward. This causes the lock cam operating parts 62 of the operating key 60 to be separated from the pressure receiving part 19*a* such that the lock cams 17 and 18 rotate in the clockwise direction as shown in arrow B of FIG. 13 by the biasing force of the spring member 32. At the same time, the driver cam operating part 61 of the operating key 60 is separated from the pressure receiving part 15*a* such that the operating rod 40 is pushed up by the returning force of the returning spring. Thus, the operating rod 40 comes to push the cam surface part 14 and rotates the driver cam 10 in the clockwise direction in FIG. 4. As a result, the engaging parts 21D of the engaging protrusions 21 become engaged with the angular corner portion 12R of the driver cam 10 to put the driver cam 10 in the locked condition. Thus, the driver cam 10 is maintained in its normal condition.

If the key switch is attached with its axis horizontally to the supporting column of the protective fence, the operating key 60 is inserted through the insertion opening 9 provided on the top surface 3*b* of the head cover 3. In this case, as the operating key 60 is inserted into the insertion opening 9, the lock cam operating parts 62 of the operating key 60 contact the pressure receiving part 20*a* and the lock cams 17 and 18 are rotated in the counter-clockwise direction as shown by arrow C in FIG. 14 against the biasing force of the spring member 32. The driver cam operating part 61 of the operating key 60 pushes the pressure receiving part 16*a* such that the driver cam 10 is rotated in the clockwise direction with reference to FIG. 4. The operations thereafter are the same as explained above and will not be repetitively described.

As described above, according to this invention, the rotation of the driver cam 10 is controlled while the lock cams 17 and 18 are not being pushed by the operating key 60 as the engaging parts 21D which is the angular part between the arcuate surface portion 21A and recessed portion 21B of the engaging protrusion 21 comes to disengageably engage with the angular corner portion 12R of the driver cam 10. As the operating key 60 is pushed to rotate the lock cams 17 and 18, the engaging protrusion 21 is rotated and the engagement is released such that the driver cam 10 is made rotatable. Thus, no dedicated device for limiting the rotation of the driver cam 10 is necessary and this means that the number of component is reduced. Moreover, the width of the operating part 2 can be made smaller because there are no head lock members to be moved in the transverse direction, unlike with the prior art devices.

The operating part 2 can be made smaller, furthermore, since the engaging protrusions 12 are provided together with the cam shaft 11 at the rotary center of the driver cam 10 and since the engaging protrusions 21 are provided together with the cam shafts 23 and 23-1 at the rotary center of the lock cams 17 and 18, and this means that the key switch as a whole can be made more compact. Since the lock cams 17 and 18 can be superposed onto the driver cam 10, the product as a whole becomes easier to assemble.

Moreover, since engaging protrusions 21 on the lock cam engage with the engaging protrusions 12 on the driver cams by undergoing a rotary motion to lock the driver cam 10, the lock cams 17 and 18 can rotate even if a foreign object becomes inserted to the engaging protrusion 21 and hence the driver cam 10 can still be locked. Thus, the rotary motion of the driver cam 10 by way of a tool such as a driver other than the dedicated operating key (actuator) can be prevented and the operation of the switch part can be prevented.

Figure 16:
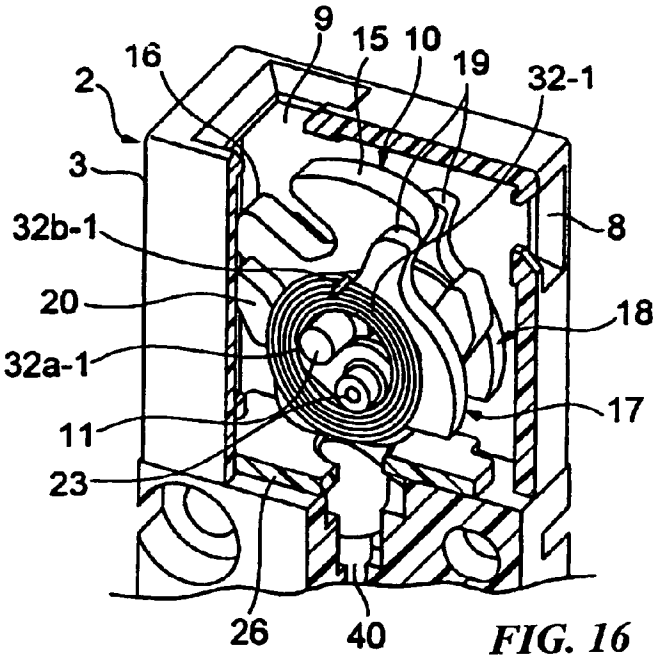
FIG. 16 is a diagonal view of another operating part of the key switch of this invention, characterized as using a spiral spring as means for holding the lock cams, shown with portions of the head cover and the base member removed.

Although the spring member 32 was described above as being a plate spring comprising an attachment part 33 and a pair of spring pieces 34 which are bent to form an acute angle with the attachment part 33, FIG. 16 shows another example wherein use is made of two coil springs 32-1 serving as holding means for the lock cams 17 and 18, the inner end 32*a*-1 of the left-hand coil spring being engaged with the left-hand lock cam 17, its outer end 32*b*-1 being engaged with the left-hand support member 27 of the base member 26, and the right-hand coil spring being similarly engaged with the right-hand lock cam 18. The coil springs 32-1 are for holding the lock cams 17 and 18 at positions where the engaging protrusions 12 and 21 will engage with each other. Since the coil springs 32-1 are structurally simple, they serve to make the assembly work easier. In summary, the present invention serves to reduce the number of components such that the overall production cost will also be reduced and to simplify the assembly work. The total width of the key switch can also be reduced and it is capable of preventing the rotation of the driver cam by any tool other than the dedicated operating key (actuator). In other words, the key switch according to the present invention is suited for use as a safety switch such as a door lock switch.

What is claimed is:

1. A key switch comprising:

a switch part; and an operating part for having an operating key inserted thereinto so as to activate said switch part to switch contact points, said operating part including:

a driver cam configured to rotate by being pushed by said operating key and to thereby activate said switch part; and a plurality of lock cams configured to directly lock said driver cam in a normal locked condition when said operating key is pulled out of said operating part and to rotate by being pushed by said operating key so as to release said driver cam from said normal locked condition;

wherein said driver cam has a first rotary shaft and a first engaging protrusion at center of rotation;

wherein said lock cams have a second rotary shaft and a second engaging protrusion at center of rotation;

wherein said second engaging protrusion becomes disengageably engaged with said first engaging protrusion to prevent said driver cam from rotating when said lock cams are not being pushed by said operating key; and wherein said second engaging protrusion is caused to rotate to thereby disengage said first engaging protrusion from said second engaging protrusion and to make said driver cam rotatable if said operating key pushes to cause said lock cams to rotate.

2. The key switch of claim 1 further comprising lock cam holding means for holding said lock cams in said normal locked condition when said operating key is pulled out.

3. The key switch of claim 2 wherein said driver cam and said lock cams rotate around different points.

4. The key switch of claim 1 wherein said first engaging protrusion is formed by connecting a first arcuate surface portion and a second arcuate surface portion which is at an edge portion opposite said second engaging protrusion and, having its center at the center of said second rotary shaft, is concave towards the center of said first engaging protrusion;

wherein said second engaging protrusions are each formed by connecting a third arcuate surface portion and a fourth arcuate surface portion which is at an edge portion opposite said first engaging protrusion and, having its center at the center of said first rotary shaft, is concave towards the center of said second engaging protrusion; and wherein said driver cam is prevented from rotating and is kept in said normal locked condition as a connecting corner part between said third arcuate surface portion and said fourth arcuate surface portion is disengageably engaged to a connecting part between said first arcuate surface portion and said second arcuate surface portion of said first engaging protrusion.

5. The key switch of claim 4 wherein said operating key has a driver cam operating part at a front edge and lock cam operating parts formed on both sides of said driver cam operating part and displaced from said driver cam operating part in the direction of the thickness of said operating key, said lock cam operating parts protruding farther forward than said driver cam operating part; and wherein said driver cam has a first pressure receiving part on which said driver cam operating part is configured to come to contact, said lock cams have a second pressure receiving part on which said lock cam operating part is configured to come to contact, and said second pressure receiving part is positioned closer than said first pressure receiving part to the center of rotation of said lock cams.

6. The key switch of claim 5 wherein said driver cam has a first arcuate opening with the center at said first rotary shaft, said lock cams have a second arcuate opening with the center at said second rotary shaft, the second rotary shafts are connected to each other by inserting said first rotary shaft through said second arcuate opening and inserting said second rotary shaft through said first arcuate opening.

7. The key switch of claim 6 wherein said second rotary shafts are connected to each other by engaging an engaging protruding portion formed on an end part of one of said second rotary shafts with an engaging indenting portion formed on an end part of the other of said second rotary shafts.

8. The key switch of claim 1 wherein said lock cam holding means includes a plate spring that serves to hold said lock cams such that said second engaging protrusion is held at a position for engaging with said first engaging protrusion.

9. The key switch of claim 1 wherein said lock cam holding means includes a coil spring that serves to hold said lock cams such that said second engaging protrusion is held at a position for engaging with said first engaging protrusion.

* * * * *